United States Patent [19]

Cohen

[11] 4,312,349

[45] * Jan. 26, 1982

[54] FILTER DEVICE FOR INJECTABLE FLUID

[76] Inventor: Milton J. Cohen, 10823 Burbank Dr., Potomac, Md. 20854

[ * ] Notice: The portion of the term of this patent subsequent to Apr. 14, 1998, has been disclaimed.

[21] Appl. No.: 111,848

[22] Filed: Jan. 14, 1980

Related U.S. Application Data

[63] Continuation-in-part of Ser. No. 59,670, Jul. 23, 1979.

[51] Int. Cl.[3] ..... A61J 1/00

[52] U.S. Cl. ..... 128/272; 128/272.3; 141/329; 141/330

[58] Field of Search ..... 128/272, 272.1, 272.2, 128/272.3, 218 M; 222/81, 189; 141/329, 330; 215/247, 248, 249

[56] References Cited

U.S. PATENT DOCUMENTS

| | | | |
|---|---|---|---|
| 2,186,888 | 1/1940 | Tullar et al. | 215/248 |
| 2,232,978 | 2/1941 | Smith | 128/218 M |
| 2,305,278 | 12/1942 | Smith | 128/218 M |
| 2,393,578 | 1/1946 | Waite | 215/248 |

FOREIGN PATENT DOCUMENTS

| | | | |
|---|---|---|---|
| 466647 | 9/1928 | Fed. Rep. of Germany | 128/272 |
| 558998 | 1/1944 | United Kingdom | 215/247 |

*Primary Examiner*—Robert W. Michell
*Assistant Examiner*—J. L. Kruter
*Attorney, Agent, or Firm*—McDougall, Hersh & Scott

[57] ABSTRACT

A filter device for injectable fluids which comprises a container secured in the open end of a vial partially filled with the injectable fluid in which the container and vial are sealed at their open ends by a rupturable sealing member and in which a filter member seals a passage communicating the interior of the container with the interior of the vial to filter gases and fluids passing through the compartment into and out of the vial.

4 Claims, 2 Drawing Figures

FILTER DEVICE FOR INJECTABLE FLUID

This is a continuation-in-part of my copending application Ser. No. 59,670, filed July 23, 1979 and entitled "Filter Device for Injectable Fluid".

This invention relates to a filter device for use in combination with a syringe for filtration of fluid medium before injection to insure removal of undesirable particulates.

In the aforementioned copending application, description is made of a device which includes a vial having a container secured in sealing relation in the open end of the vial with a wall subdividing the container into two compartments, each of which is provided with a self sealing member, one of which opens in response to pressure differential between one compartment and the interior of the vial when the pressure in the one compartment is greater than the pressure within the vial and the other of which is open when the pressure in the other compartment is less than the pressure within the vial. Each compartment is provided with a filter whereby pressurizing air introduced into the one compartment will be filtered as it flows under positive pressure through the filter and the opened sealing member into the vial to pressurize the interior of the vial and whereby fluid flows from the vial through the opened sealing member and filters into the other compartment in response to withdrawal by a syringe in communication with the other compartment after the device has been inverted.

It is an object of this invention to provide a filter device of the type described which is simplified in construction; which can be made available at greatly reduced cost, and which can be handled with greater ease and with less chance of error.

Figure 1:
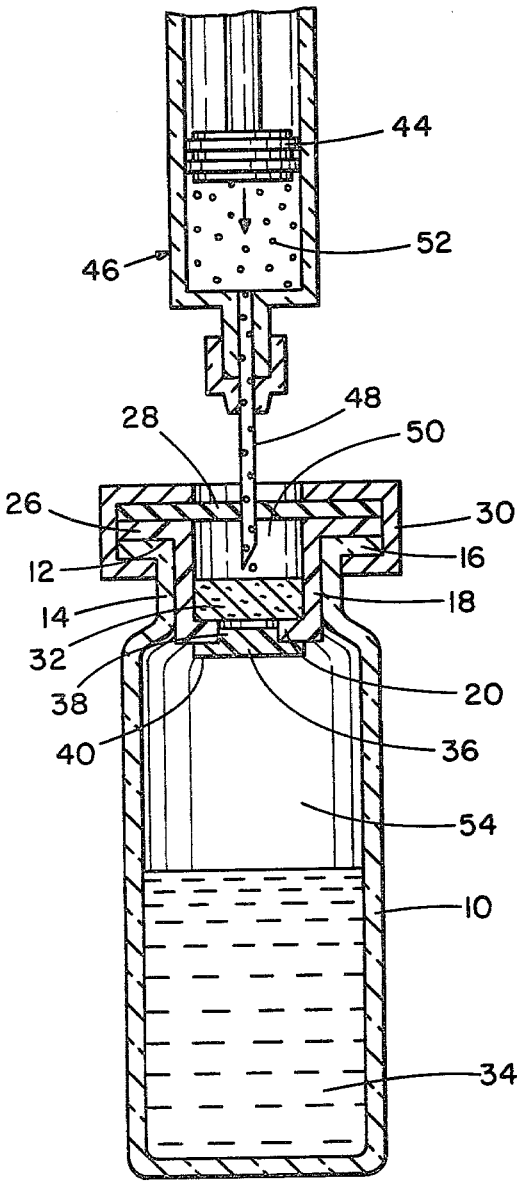
Figure 2:
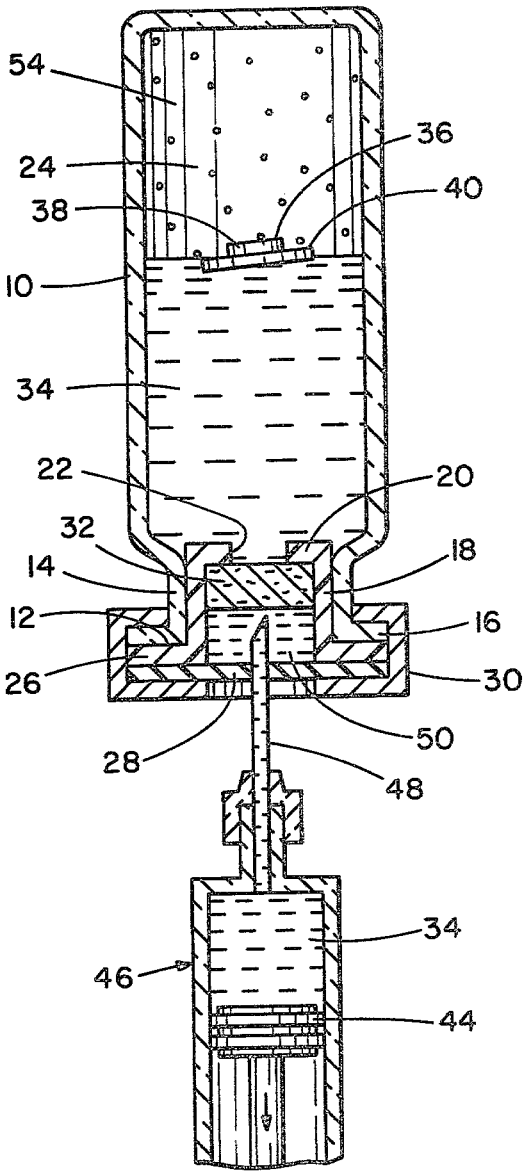

These and other objects and advantages will hereinafter appear, and for purposes of illustration, but not of limitation, an embodiment of the invention is shown in the accompanying drawings in which:

FIG. 1 is a sectional elevational view showing the device embodying the features of this invention in a syringe pressuring mode; and FIG. 2 is a section view showing the device in a fluid delivery mode.

As illustrated in the drawings, the device of this invention comprises a vial 10 formed of glass, plastics, metal or the like, fluid and vapor impervious material. The vial has an open end 12 defined by a neck portion 14 which terminates in an outwardly extending annular lip 16.

Extending into the neck portion 14 in sealing relation is a tubular container 18 having a bottom wall 20 with an opening 22 of smaller dimension providing a passage between the interior of the container 18 and the interior 24 of the vial 10, while the open upper end portion of the container is formed with an outwardly extending annular flange 26 which overlies the lip portion 16 of the vial 10.

The open upper end of the container is sealed by a sealing disc 28 formed of a rupturable, fluid and vapor impervious material, such as rubber, plastic or other synthetic elastomeric material. The sealing disc 28 is dimensioned to span the open upper end of the container and to overlie the annular flanged portion of the container to enable the sealing disc to be secured in sealing relation by means of a crimp cap 30 which embraces the overlapped portions of the sealing disc 28, annular flange 26 and lip 16 for maintaining a sealing relation therebetween. The crimp cap can be formed of aluminum or other metal or plastic material.

A fine filter disc 32 is dimensioned to be received in fitted relation within the interior of the container, in the lower end portion of the container at rest on the portions of the bottom wall 20 immediately surrounding the opening 22. The filter disc is of the type used in biomedical science such as formed of metal fibers and the like impervious material having very fine pores for ultrafiltration.

The interior 24 of the vial 10 is partially filled with the fluid medium 34 to be injected. The fluid medium 34 is separated from the interior of the container by a removable plug 36 having a reduced end portion 38 which is received in sealing relation within the passage with a flanged portion 40 of larger dimension overlapping the underside of the bottom wall 20 to maintain separation between the fluid and the filter 32.

The sealed upper end portion of the device is provided with a removable cover (not shown), such as a tear off aluminum cover, to protect the seal of the loaded device prior to use.

In use, the cover is removed from the device to expose the sealing disc 28. With the plunger 44 of a syringe 46 withdrawn, the sealing disc 28 is pierced by the syringe needle 48 until the end of the needle is located in the open space 50 of the container 14 between the filter disc 32 and the sealing disc 28. Thereafter, the plunger 44 of the empty syringe is displaced forwardly to force air from the barrel 52 of the empty syringe into the container 14.

In response to the initial displacement of air from the syringe into the container, the plug 36 is dislodged whereby continued displacement of the plunger forces air from the syringe into the container and through the filter disc 32 and into the vial to pressurize the interior of the vial with filtered air.

Thereafter, the assembly is inverted to bring the vial uppermost so that the area 54 occupied by the gaseous phase will be uppermost in the vial while the fluid 34 will be lowermost to cover the sealing disc 32. Now in response to withdrawal of the plunger 44 and the positive pressure conditions existing above the liquid medium in the vial, liquid medium will be caused to flow from the vial through the opening 22 and through the filter disc 32 into the space 50 from which the filtered liquid medium is withdrawn through the needle 48 into the syringe 46. When the desired amount of filtered liquid medium has been withdrawn, the syringe can be removed for injection of the filtered liquid medium into the desired site, while the pierced sealing disc returns to reestablish the sealing relation.

It will be apparent from the foregoing that the air entering the vial for pressurizing the interior and the liquid medium removed from the vial will be filtered so as to maintain the desired sterile conditions to deliver liquid medium free of contamination.

It will be understood that different filters can be used for different purposes with one of the features being, that the filter can merely be dropped into position within the stopper, which facilitates the position of same, in that no molding, heat seal or sealing compound is used to hold the filter in the stopper, this idea greatly simplifying placement and the retaining of the filter, according to the desires of the individual company for its particular filter.

It will be further understood that changes may be made in the details of construction, materials and arrangement without departing from the spirit of the invention, especially as defined in the following claims.

I claim:

1. A device for filtering fluid during flow into and out of the device comprising a vial open at one end and adapted partially to be filled with the fluid, a container which extends into the open end portion of the vial, said container being open at one end and closed at the other end with the open end of the container alongside the open end of the vial, a passage through the closed end of the container communicating the interior of the container with the portion of the vial beyond the container, a removable sealing plug seated within the passage to maintain separation between the interior of the container and the interior of the portion of the vial beyond the container, a rupturable sealing disc sealing the open end of the vial and container, a filter member positioned within the container to extend across the passage in sealing engagement with the surrounding container walls and spaced from the open end, to provide a compartment in the container between the sealing disc at one end and the filter member at the other end whereby when a syringe is inserted through the rupturable disc into the portion of the container between the rupturable disc and the filter for introduction or withdrawal of fluid to and from the vial, such fluid must pass through the filter member.

2. A device as claimed in claim 1 which includes a removable cover overlying the sealed open end portion of the vial.

3. A device as claimed in claim 1 in which the vial is formed of a clear vapor and fluid impervious material.

4. A device as claimed in claim 1 in which the removable sealing plug comprises a cylindrical member having one portion of the cross section corresponding to the cross section of the passage for receipt in said passage in sealing relation, and a contiguous portion of larger cross section which abuts the outer portion of the container wall adjacent the passage whereby when unsealed the plug is displaced into the interior of the vial portion beyond the container.

* * * * *